US007285057B2

(12) United States Patent
Mann, Jr. et al.

(10) Patent No.: US 7,285,057 B2
(45) Date of Patent: Oct. 23, 2007

(54) VARIABLE SCORELINE GOLF CLUB GROOVE CONFIGURATION

(75) Inventors: James A. Mann, Jr., Walhalla, SC (US); Chris Chappell, deceased, late of Westminster, SC (US); by Janice Chappell, legal representative, Westminster, SC (US)

(73) Assignee: TaylorMade-Adidas Golf Company, Carlsbad, CA (US)

( * ) Notice: Subject to any disclaimer, the term of this patent is extended or adjusted under 35 U.S.C. 154(b) by 0 days.

(21) Appl. No.: 11/374,759

(22) Filed: Mar. 13, 2006

(65) Prior Publication Data

US 2006/0154739 A1 Jul. 13, 2006

Related U.S. Application Data

(63) Continuation of application No. 10/765,825, filed on Jan. 26, 2004, now abandoned.

(60) Provisional application No. 60/442,248, filed on Jan. 24, 2003.

(51) Int. Cl.
*A63B 53/04* (2006.01)

(52) U.S. Cl. ..... 473/331; 473/350

(58) Field of Classification Search ..... 473/327–328, 473/330–331, 350; D21/750–751
See application file for complete search history.

(56) References Cited

U.S. PATENT DOCUMENTS 6,267,691 B1 * 7/2001 Dammen ..... 473/329

* cited by examiner

*Primary Examiner*—Stephen Blau
(74) *Attorney, Agent, or Firm*—Lorusso & Associates

(57) ABSTRACT

A golf club head having a toe portion, a heal portion and a club front intended striking face with a plurality of substantially parallel grooves formed in the face and extending horizontally between the toe portion and the heel portion. Each groove has a groove width such that the groove width increases from a center portion of the face towards the toe portion and the heel portion.

7 Claims, 6 Drawing Sheets

VARIABLE SCORELINE GOLF CLUB GROOVE CONFIGURATION

CROSS REFERENCE TO RELATED APPLICATIONS

"This is a continuation of, and a claim of benefit is made to, U.S. Ser. No. 10/765,825, filed Jan. 26, 2004, now abandoned, which is a continuation-in-part of U.S. Ser. No. 60/442,248, filed Jan. 24, 2003, the contents of each are incorporated by reference herein in their entirety."

BACKGROUND OF THE INVENTION

The present invention relates to the grooves formed across the club face of golf clubs including irons, drivers, woods and particularly wedges.

Golf club wedges are usually designed with varying degrees of loft generally ranging from a minimum of about 48 degrees to a maximum of about 64 degrees. The varying degrees of loft help to control the trajectory and distance a golf ball will travel.

In play, especially with the higher numbered irons and wedges, control is obtained in part by means of backspin. At the time of impact, the golf ball is contacted against the club face with substantial deformation. Control of the ball in flight is partly exercised by backspin, and more control is obtained on the initial bounce (i.e., the ball will "bite" or hold the surface better after the initial bounce) when the ball has the proper backspin. Thus, the higher the rate of backspin, the greater the control.

To achieve backspin, multiple grooves are cut across the club face of a golf club. These grooves grip the ball momentarily upon impact as it is driven, which in turn generates backspin on the ball. By and large, the most popular and common groove configurations employed today are the V-shape and square shape. Although these conventional configurations succeed in creating backspin, it is desirable to impart more spin to golf balls so that greater control can be achieved. While the V-shape is used, it is commonly used so that a golf club set contains either all V-shape or all square shape.

Having all grooves identical is a performance compromise that prior art golf club manufacturers were previously unaware of because the V-shape groove is not suited for all clubs in a set to maximize performance. The square shaped groove however also has many deficiencies, the largest being the cuts and shear produced on the cover of a golf ball leading to premature failure of a golf ball.

SUMMARY OF THE INVENTION

The invention produces a set of golf clubs that are optimized in performance while minimizing golf ball cover damage. It has been discovered that a set of clubs is optimized for playing performance when a club configuration selected from the group consisting of clubs 1, 2, 3, 4, 5, 6, and 7 have a reduced volume groove such as a "V" shaped grooves and/or a groove configuration or modification that produces less spin, which is desirable for shots using those clubs. A club configuration selected from the group consisting of 8, 9, pitching wedge, gap wedge and sand wedge is optimized in the club set when it has an increased volume groove configuration such as "U" shaped grooves and/or a modified configuration or similar type grooves for greens shots.

The "V" groove has a centerline spacing of about 0.05 to about 0.300 inches between at least one additional V groove configuration, a first surface angle that is about 20 to about 50 degrees from the center of the groove, a second surface angle that is about 20 to about 50 degrees from the center of the groove, a groove depth of about 0.005 to about 0.04 inches, and a groove width of about 0.01 to about 0.05 inches.

The decreased volume grooves can be spaced equally apart with identical dimensions or the spacing can be unevenly spaced (5% to 50% further apart in center) and has either an increased width or reduced depth (5% to 50% respectively) in the center compared to the outer portion of the club face, or alternatively, increased width and reduced depth (5% to 50% less respectively) that may also be used in conjunction with modified spacing in the center, compared to grooves at the outer portion of the club face, thus optimizing the focal point of the club face for ball impact.

The reduced volume groove configuration such as a "V" groove also helps to promote a "flyer" condition when playing from wet grassy areas because of an increased hydroplaning effect because of the reduced volume of the groove on the club face.

A club configuration selected from the group consisting of 8, 9, pitching wedge, gap wedge and sand wedge is optimized in the club set when it has an increased groove volume such as a "U" configuration. The "U" configuration may have a substantially flat groove bottom that can either be parallel to the club face or offset at any angle so that the groove depth changes from the top edge to the bottom edge (angled to club face) or side to side so that the center of the club face has a greater depth (5% to 200% deeper, preferably at least 50%+/−15% deeper) than the groove at the edges (formed by an arc or angle). The "U" groove configuration has a centerline spacing of about 0.05 to about 0.300 inches between at least one additional U groove configuration which can vary.

The increased volume grooves can be spaced equally apart with identical dimensions or the spacing can be unevenly spaced (5% to 50% closer in center) and has either increased depth or width (5% to 50% respectively) in the center compared to the outer portion of the club face, or alternatively, both increased width and increased depth (5% to 50% more respectively). Also, this may be used in conjunction with modified spacing in the center, compared to grooves at the outer portion of the club face, thus optimizing the focal point of the club face for ball impact, with a goal of increasing spin and reducing flyer conditions and increasing spin, both of which are achieved by having greater groove volume in the center portion of the club face.

The "U" groove configuration has a first surface angle that is about 5 to about 25 degrees relative to an imaginary surface 90 degrees to the club surface, and a second surface angle that is about 5 to about 25 degrees relative to an imaginary surface 90 degrees to the club surface that may be set equal to each other, or to different angles.

The "U" configuration has a groove depth of about 0.005 to about 0.04 inches which can be set equal along the length of the groove or vary with the deepest portion placed in the center of the club face. The "U" groove configuration has a groove width of about 0.01 to about 0.05 inches that can vary from the club edge to the center with the width being greatest in the center.

The increased volume configuration and "U" grooves create additional surface area that imparts better grip and more spin upon the ball leading to better control in the greens. Also, the increased volume grooves reduce the "flyer" condition in wet grass due to the ability to channel the water away from the ball/club interface when hitting the ball, which minimizes the hydroplaning effect.

Thus, it is an object of the present invention to optimize a golf club set so that certain clubs generate a higher rate of backspin on a driven golf ball thereby enabling the ball to better grip and hold the playing surface.

It is a further object of the present invention to provide golf clubs including irons, drivers, woods and particularly wedges that will provide a golfer with greater control over a golf ball.

Accordingly, the present invention achieves the objectives set forth above by tailoring grooves to specific clubs and tailoring complete sets of clubs. This enhanced grip induces more backspin on the ball, which in turn provides more control over the ball when it lands on the playing surface (i.e., the ball will hold the playing surface better after its initial bounce).

The above and other features of the invention, including various novel details of construction and combination of parts, will now be more particularly discussed with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features will be apparent.

In the drawings.

DETAILED DESCRIPTION OF THE INVENTION

The present disclosure applies to golf clubs, which includes wedges irons, drivers and woods. The groove design of this invention is ideal for tailoring golf ball spin based on shot type through controlling spin. The design allows for maximum golf ball performance by increasing spin when needed, while simultaneously reducing cover damage of the golf ball.

Figure 1:
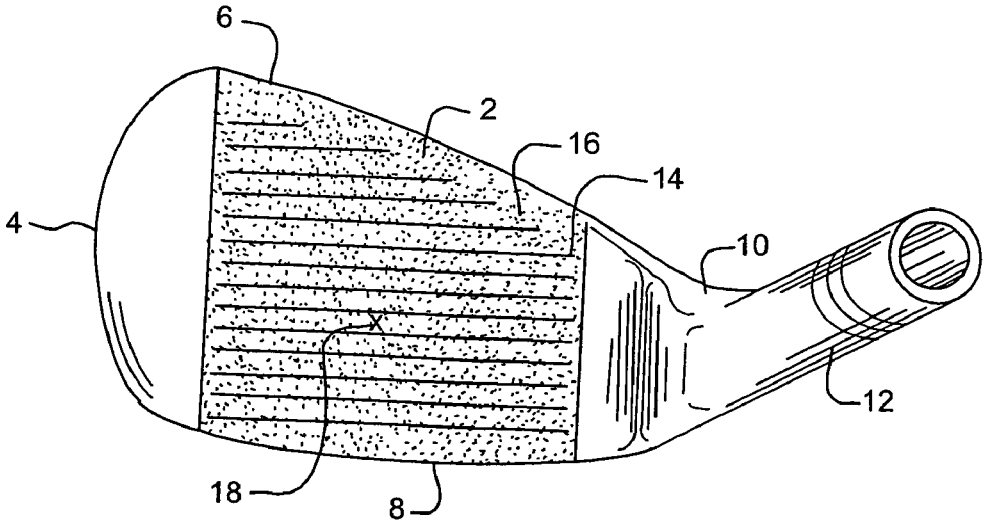
FIG. 1 shows a front view of a wedge club head of one embodiment of the invention.
Figure 2:
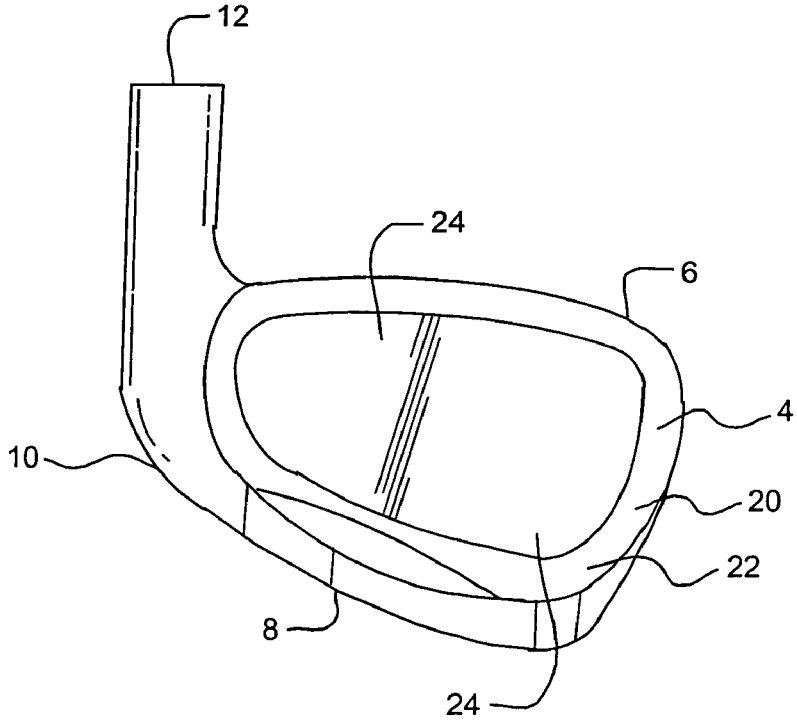
FIG. 2 shows a configuration of one embodiment of the invention.

Referring to the drawing, and particularly FIGS. 1 and 2, it will be seen that the illustrative golf clubhead of one embodiment includes a blade member 2 having a toe portion 4, a top ridge 6, a bottom sole portion 8 and a heel portion 10. Extending from the heel portion region of the clubhead is a hosel portion 12 adapted to receive and be retained on a shaft member (not shown).

The club head is provided with preferably a substantially flat surface or club face 16 which is the front intended striking face, but the club face is not limited to being flat, having therein a center of percussion 18, which is the spot ideally adapted to engage a golf ball at impact, and a rear surface 20 having a perimeter 22 defining an optional cavity 24. Cut into the club face 16 are a series of grooves 14 that may be arranged in parallel fashion and are usually uniformly spaced in relation to one another in accordance with one embodiment of the invention; however, in a different embodiment, said grooves can be spaced non-uniformly and/or can be arranged in a non-parallel fashion. The number of grooves 14 can vary, but a typical number across the club face ranges from at least one to about twenty five grooves.

Before a groove is cut into the club face, the club face may be preferably milled perfectly flat, thereby removing any and all variations in face flatness. In addition, the milled club face may be finished or treated. Once the work on the club face is completed, each individual groove is typically engraved into the club face one at time but they may be molded or stamped depending on the process of manufacturing chosen.

It should be noted that all of the groove configurations described herein apply to the full range of wedges (48 to 64 degree), as well as to all other golf clubs including irons, drivers and woods and any other known or future discovered golf clubs. Furthermore, in all groove configurations described below, the individual grooves in each configuration may be spaced 0.05 to 0.2 inch apart, more particularly, 0.1 to 0.15 inches, most particularly, about 0.105 inch apart.

Figure 3A:
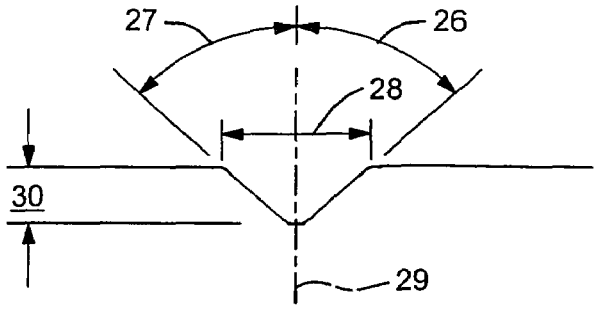
FIG. 3A and 3B shows a reduced volume groove, specifically, a "V" groove with optimized groove spacing on a club face using constant depth grooves.
Figure 3B:
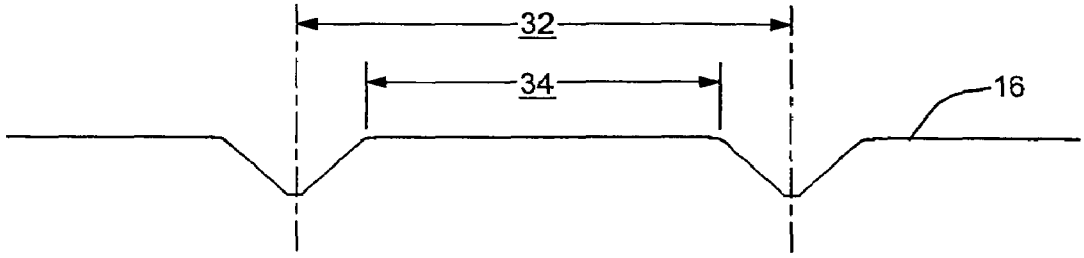

FIG. 3A shows a reduced volume grove configuration, wherein the "V" groove configuration may be selected because it has a reduced volume and has a centerline spacing 32 of about 0.05 to about 0.300 inches between at least one additional V groove configuration as displayed in FIG. 3B, a first surface angle 26 that is about 20 to about 50 degrees from the center of the groove 29, a second surface angle 27 that is about 20 to about 50 degrees from the center of the groove 29, a groove depth 30 of about 0.005 to about 0.04 inches, and a groove width 28 of about 0.01 to about 0.05 inches. The groove depth 30 is between 0.005 and 0.040 inches deep. The centerline groove spacing width 32 measures the distance from the two centers of adjacent "V" grooves. The centerline groove width can vary from 0.07 to 0.5 inches and may be held constant throughout the club face or it may be variable as discussed herein either closer or further apart depending on the grooves position on the club face. The measurement of the spacing from groove edge to groove edge is edge spacing 34 of 0.05 to 0.3 inches as displayed in FIG. 3B.

Figure 4:
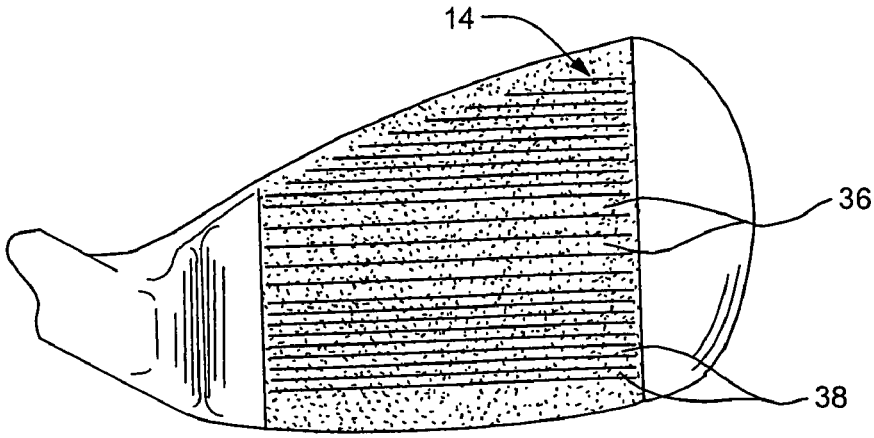
FIG. 4 shows a groove configuration with modified spacing to create a reduced groove volume.

FIG. 4 shows an example of modified groove spacing configuration to create a reduced groove volume. The grooves 14 can be spaced equally apart with identical dimensions as in FIG. 1 or the spacing can be unevenly spaced as displayed in FIG. 4 (5% to 50% further apart in center grooves 36) with outer groove spacing 38 being closer together than center groove spacing 36. Alternatively increased groove spacing may be combined with a reduced depth (5% to 50% less depth respectively) and may also be used in conjunction with "V" grooves. This modified spacing in the center, compared to grooves at the outer portion 38 of the club face, optimizes the focal point of the club face for ball impact.

The decreased volume grooves being wider spaced apart in the center decreases the effective groove volume in contact with the ball thus decreasing spin and also creating a flyer condition through increased hydroplaning in wet conditions.

Figure 5:
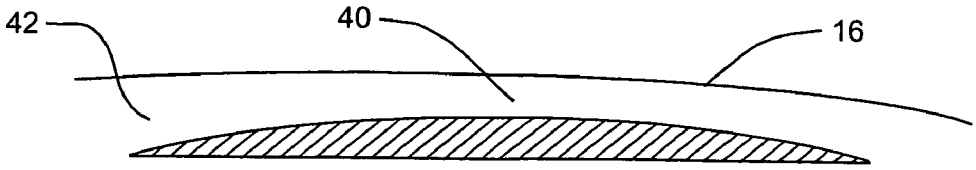
FIG. 5 shows a reduced volume groove cross section having a reduced center depth.

FIG. 5 shows a groove cross-section with a reduced center depth 40 to decrease groove volume. While this may be a "V" groove as displayed in FIG. 3A, the groove can also have a reduced width 28 or reduced depth 30 (5% to 50% respectively) in the center of the club face compared to the outer groove portion 38 of the club face. The groove edge depth 42 is optionally deeper than center groove depth 40. The reduced depth in the center further decreases spin imparted to the ball when struck and increases a flyer condition from having a reduced groove volume. The groove can be produced through molding, casting, injection molding, stamping and most preferably through CNC machining process. The depth of the "V" grooves can be produced easily by one skilled in machining by varying the height of the tool relative to the face of the club thus cutting deeper at the edges than the center where the machining height is raised. It is likely that a second machining operation is required for each groove to keep width constant.

Figure 6:
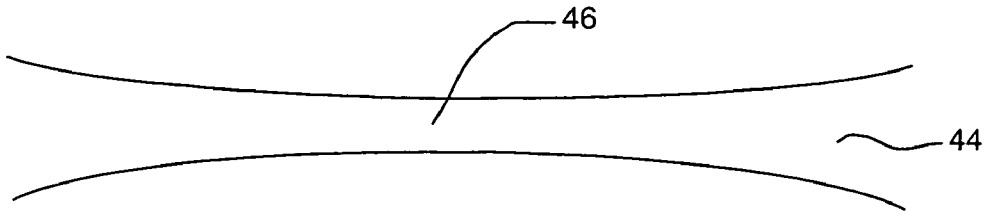
FIG. 6 shows a top view of a convex width groove with a reduced center width and optionally a reduced depth in the center.

FIG. 6 shows a top view of a reduced volume groove having a reduced width in the center. This may be combined with a reduced depth also in the center 40. This allows for reduced volume in the groove in the center. The groove edge width 44 is wider than the center groove width 46. The reduced width in the center further decreases spin imparted to the ball when struck and increases a flyer condition from having a reduced groove volume. The groove can be produced through molding, casting, injection molding, stamping and most preferably through CNC machining process. The grooves width can be produced easily by one skilled in machining by varying the height of the tool relative to the face of the club thus cutting deeper at the edges than in the center where the machining height is raised. It is likely that only one machining operation is required for each groove to increase width at the edges. If the depth is desired to be held constant and not vary with the width it will be necessary to perform multiple machining operations or produce a tool that has a cutting angle which changes with cutting depth. This tool can be produced easily by one skilled in the art of CNC machining.

Figure 7A:
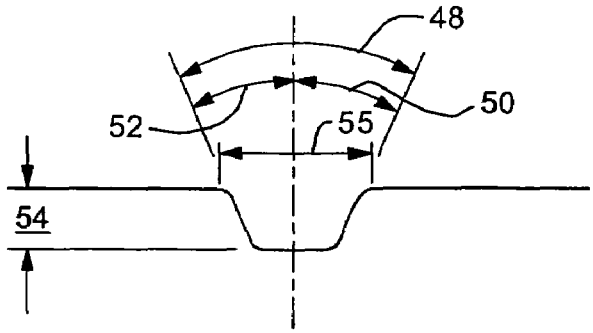
FIGS. 7A and 7B shows one embodiment of an increased volume groove in a "U" groove configuration of one embodiment of the invention
Figure 7B:
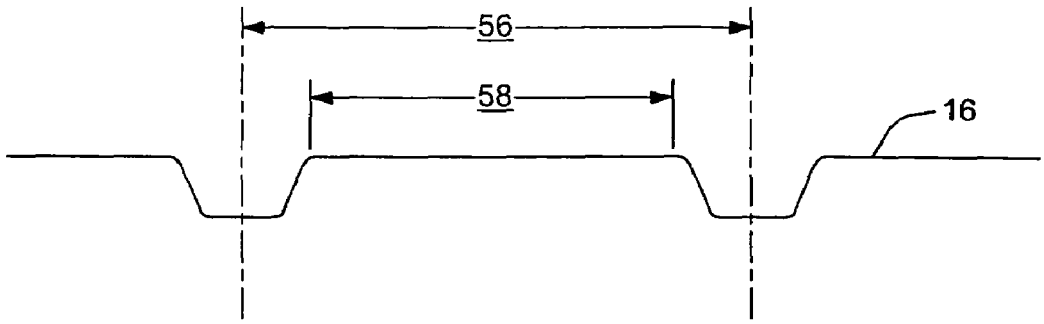

FIGS. 7A and 7B show an increased volume groove, specifically, a "U" groove configuration of one embodiment of the invention. The "U" groove configuration has a first surface angle 50 that is about 5 to about 25 degrees relative to an imaginary surface 90 degrees to the club surface 16, and a second surface angle 52 that is about 5 to about 25 degrees relative to an imaginary surface 90 degrees to the club surface 16 that may be set equal to each other making total groove angle 48 being twice that of either first or second surface angle 50, 52, or to different angles calculated by the sum of the first and second surface angles 50, 52.

The "U" configuration has a "U" groove depth 54 of about 0.005 to about 0.04 inches which can be set equal along the length of the groove or vary with the deepest portion placed in the center of the club face. The "U" groove configuration has a groove width 55 of about 0.01 to about 0.05 inches that in FIG. 10 can vary from the club edge "U" groove width 53 to the center "U" groove width 51, with the width being greatest in the center.

In FIG. 7B the U groove centerline width 56 can be about 0.14"+/−20%. The U groove edge spacing 58 can be 0.105"+/−30%. The "U" configuration's additional surface area imparts better grip and more spin upon the ball leading to better control in the greens. Also the "U" configuration reduces the "flyer" condition in wet grass due to the ability to channel the water away from the ball/club interface when hitting the ball, which thus minimizes the hydroplaning effect.

Figure 8:
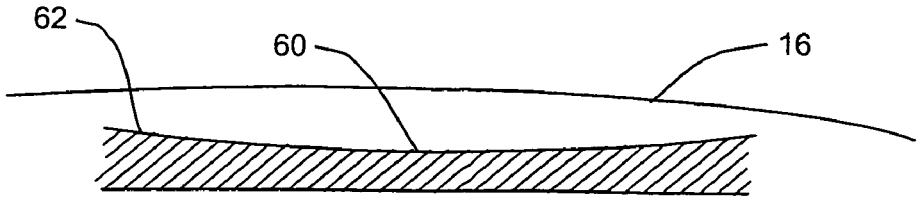
FIG. 8 shows an increased volume groove configuration cross sectional view having an arced bottom with increased center depth.

FIG. 8 shows an increased volume groove configuration cross-sectional view having an arced bottom with an increased center depth 60 that can be flat across the groove width. The modified depth groove may also have a center "U" groove portion 60 that has a greater depth than the outer "U" groove portion 62. This allows for greater groove volume in the center to maximize water dispersion when playing in wet grass to prevent a "flyer" condition caused by hydroplaning. Additionally, the deeper grooves impart greater spin on the ball allowing for more control. The groove can be produced similar to the "V" groove as discussed above, preferably with a CNC milling machine produced with a custom tool. One skilled in the art of CNC machining would be able to produce the tool with minimal guidance. The depth of the groove is controlled by varying the position of the machine tool in relation to the club face. The first and second "U" groove edges can be produced in one operation if the angles are the same or in two or more operations depending on the configuration combination selected.

Figure 9:
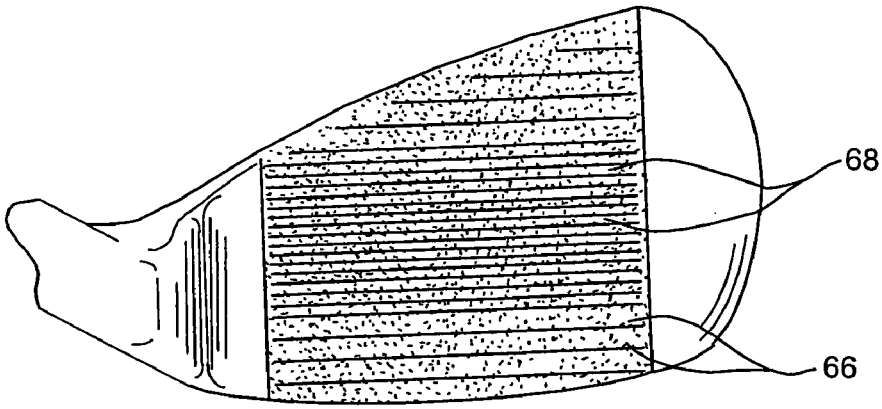
FIG. 9 shows an increased volume groove configuration having grooves spaced closer together in the center of the club face.

FIG. 9 shows an increased volume groove configuration having closer spaced center grooves 68 in the center of the club face. The outer groove spacing 66 is spaced wider apart than the inner groove spacing 68 allowing for more grip and greater spin to be imparted on the ball during desired shots that would correspond to the selected club. Furthermore, the decreased spacing in the center between grooves would help to reduce hydroplaning and decrease a "flyer" condition in wet grass conditions.

Figure 10:
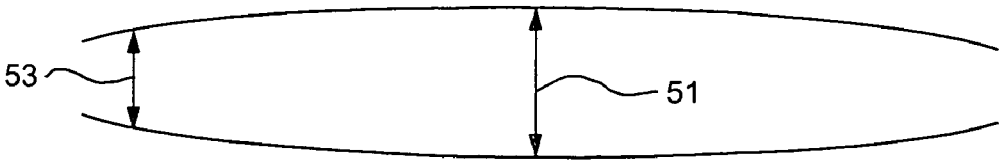
FIG. 10 shows an embodiment of an increased volume groove configuration with wider groove center width.

FIG. 10 shows another embodiment of the increased volume grooves with a configuration having wider groove center width, which can vary from the club edge groove width 53 to the center groove width 51, with the width being greatest in the center. The groove width variations can be produced easily by one skilled in the art of CNC machining arts.

Figure 11:
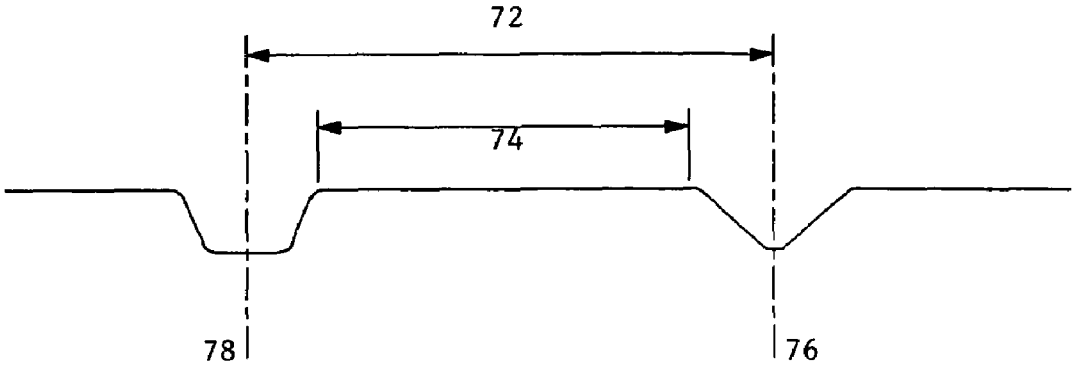
FIG. 11 shows an embodiment of the "U" groove combined with the "V" groove configuration, wherein either type groove is placed in the center of the club face depending on if a high or low volume center is desired.

FIG. 11 shows an embodiment of a combination of a "U" groove and a "V" groove configuration, wherein the combination centerline width can be 0.14"+(20-50%) with a plurality of the "V" grooves located in the center for the reduced volume configuration. Conversely, for the increased volume groove configuration the "U" groove is in the center and the centerline width is 0.14"−(20-50%). All modifications to the configurations can be made to this embodiment as directed above depending on the driver selected and whether a reduced or increased volume is desired.

It will be appreciated that the lengths, angles and radii of the modified groove configurations described above can be varied to create different spin characteristics of a golf ball when struck by a golf club employing any of the groove configurations of the present invention. All grooves can be combined in different combinations with any other type of groove to modify the clubs performance.

While various embodiments have been shown and described, it will be understood that the present invention is by no means limited to the particular constructions herein disclosed and/or depicted in the drawings, but also comprises any modifications or equivalents within the spirit and scope of the disclosure.

We claim:

1. A golf club head comprising:

a toe portion;

a heel portion;

a club front intended striking face; and a plurality of substantially parallel grooves formed in the club face and extending horizontally between the toe portion and the heel portion, each groove having a groove width;

wherein the groove width increases from a center portion of the club face towards the toe portion and the heel portion.

2. The golf club head of claim 1, wherein a groove width measured at a center portion of the club face is about 5% to about 50% less than a groove width measured at the toe portion or the heel portion of the club face.

3. The golf club head of claim 1, each groove further having a groove depth, wherein the groove depth increases from a center portion of the club face towards the toe portion and the heel portion.

4. The golf club head of claim 1, wherein each of the plurality of grooves has a V-shaped cross-section.

5. The golf club head of claim 4, further comprising a centerline spacing measured between adjacent grooves, wherein the centerline spacing is within a range of about 0.05 inches to about 0.300 inches.

6. The golf club head of claim 4, wherein the groove width is within a range of about 0.01 inches to about 0.05 inches.

7. The golf club head of claim 4, each groove further having a groove depth, wherein the groove depth is within a range of about 0.005 inches to about 0.04 inches.

* * * * *